US007475921B2

(12) United States Patent
Knoll et al.

(10) Patent No.: US 7,475,921 B2
(45) Date of Patent: Jan. 13, 2009

(54) DEVICE WITH AN EQUIPMENT DOOR, AN ACTUATOR UNIT AND A BOLTING DEVICE ELEMENT

(75) Inventors: Helmut Knoll, Nussdorf (DE); Rainer Lebacher, Palling (DE); Jorg Rosenbauer, Nussdorf (DE); Michael Wagner, Traunstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/726,470

(22) Filed: Mar. 21, 2007

(65) Prior Publication Data

US 2007/0236022 A1 Oct. 11, 2007

(30) Foreign Application Priority Data

Mar. 23, 2006 (DE) ..... 10 2006 013 519

(51) Int. Cl.
*E05C 3/04* (2006.01)

(52) U.S. Cl. ..... 292/202; 292/DIG. 69; 126/197

(58) Field of Classification Search ..... 292/DIG. 69, 292/101, 103, 238, 202–204; 126/197
See application file for complete search history.

(56) References Cited

U.S. PATENT DOCUMENTS

| | | | | |
|---|---|---|---|---|
| 2,123,521 | A * | 7/1938 | Ragnar | 414/684.3 |
| 2,394,784 | A * | 2/1946 | Kelly | 292/240 |
| 2,529,009 | A * | 11/1950 | Foss | 292/202 |
| 3,011,816 | A * | 12/1961 | Noord | 292/111 |
| 3,507,531 | A * | 4/1970 | Smith | 292/241 |
| 5,887,916 | A * | 3/1999 | Finkelstein et al. | 292/241 |
| 7,255,376 | B2 * | 8/2007 | Pratt et al. | 292/201 |

FOREIGN PATENT DOCUMENTS

DE 40 40 343 6/1992

* cited by examiner

*Primary Examiner*—Gary Estremsky
(74) *Attorney, Agent, or Firm*—Russell W. Wamock; James E. Howard

(57) ABSTRACT

A device with an equipment door (10), an actuator unit (12) and a bolting device element (14) for bolting the equipment door (10), particularly when performing a pyrolysis function, wherein the actuator unit (12) is provided for bringing the bolting device element (14) into engagement with a corresponding bolting device element (15) of the equipment door (10) for locking the equipment door (10) when the equipment door (10) is closed. The bolting device element (14) may be rotatable about a rotating axis (16) running at least essentially perpendicularly to a door plane of the equipment door (10) when the equipment door (10) is closed.

14 Claims, 3 Drawing Sheets

DEVICE WITH AN EQUIPMENT DOOR, AN ACTUATOR UNIT AND A BOLTING DEVICE ELEMENT

Figure 1:
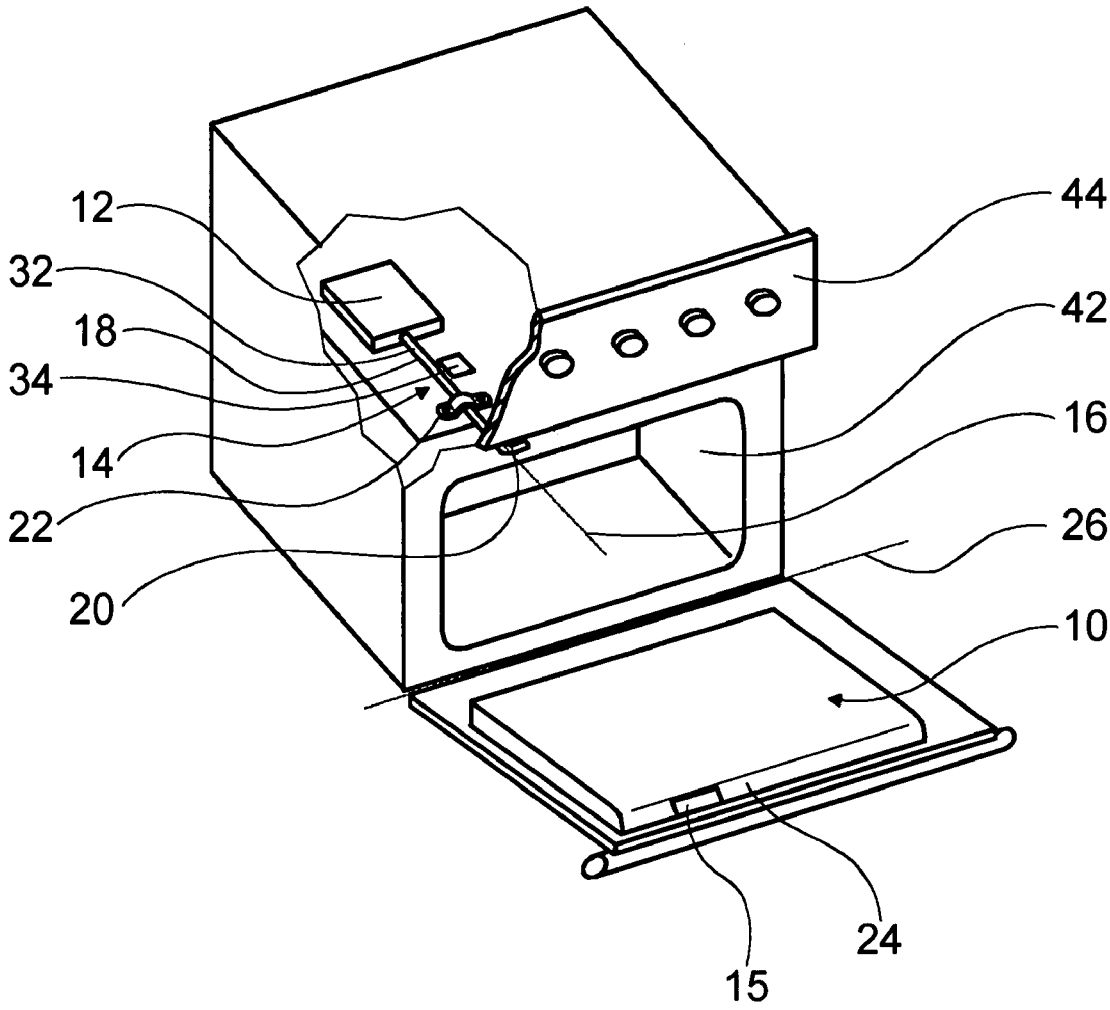

The invention relates to a device with an equipment door, an actuator unit and a bolting device element according to the preamble of claim 1.

DE 40 40 343 C2 discloses a device, more precisely a cooking device, with an equipment door, an actuator unit and a bolting device element for locking the equipment door. The bolting device element is used in particular for performing a pyrolysis function. The actuator unit is provided for bringing the bolting device element into engagement with a corresponding bolting device element or a locking shell of the equipment door for locking the equipment door when it is closed.

The object of the invention is, in particular, to design a generic device so that it is space-saving and inexpensive. The object is achieved by a device with the characteristics of claim 1. Further advantageous designs and further developments of the invention are evident from the dependent claims.

The invention relates to a device with an equipment door, an actuator unit and a bolting device element for locking the equipment door, in particular for performing a pyrolysis function, the actuator unit being provided for bringing the bolting device element into engagement with a corresponding bolting device element of the cooking unit door for locking the cooking unit door when it is closed.

The actuator unit may be designed in a manner that appears logical to the person skilled in the art, for example as a wax element, electric motor or solenoid, whose movement is converted to a rotary movement.

It is proposed that the bolting device element is rotatable about a rotation axis running at least essentially perpendicularly to a door plane of the equipment door when the equipment door is closed. For this purpose the installation space required to construct an axially displaceable bolting device element can be saved and, in particular, an installation space of the bolting device element, required in a front region of the cooking unit, can be utilized extremely efficiently. In particular, a depth of the installation space to be utilized for the freedom of movement of the bolting device element, can be limited essentially to the material thickness of the bolting device element. Furthermore, the actuator unit can easily be disconnected from the forces acting on the bolting device element. This generally enables both the actuator unit and the bolting device element to be designed at a lower cost compared to generic devices of prior art.

The phrase "running at least essentially perpendicularly to a door plane of the equipment door" relates in this context to a rotation axis whose angle to the door plane ranges between 70° and 110°, preferably between 80° and 100°, so that a component of a movement of the bolting device element in the door plane is in any case greater than a component perpendicular to it.

In a further development of the invention it is proposed that the bolting device element has a locking hook running at least essentially perpendicularly to the rotation axis. From the design viewpoint this enables a positive connection to be easily achieved between the bolting device element in its looking configuration and the cooking device door.

The actuator unit may be arranged at almost any point on the cooking unit if the bolting device element comprises a rod which bridges a distance between the actuator unit and the locking hook. Consequently an installation space inside the cooking device can be used extremely efficiently.

The actuator unit may be effectively screened against locking forces acting on a front region of the bolting device element if the rod is mounted rotatably and axially fixedly in a guide bearing on a cooking device body. The mounting may, for example, be carried out by means of a groove in the rod or a mounting ring engaging in such a groove.

The actuator unit may be of a simple design and is arranged at a distance from an operating diaphragm and a control unit for the cooking device if the distance between the actuator unit and the locking hook is at least 20 cm. The locking device according to the invention may be used, in particular, without essential structural modifications in conjunction with operating diaphragms or control electronics of prior art since only a narrow opening is required for passing through the rod.

A low cost, simply constructed locking device can be achieved in that the corresponding bolting device element of the equipment door is designed as a recess in a lateral edge surface of the equipment door.

If the equipment door is pivotable about a pivoting axis running along a first edge, and if the corresponding bolting device element is arranged on a lateral edge of the equipment door opposing the first edge, it is possible for the bolting device element to utilize an optimum lever action. This enables the bolting device element and the corresponding bolting element to be designed at low cost for a locking force that is lower than an arrangement in the region of the pivoting axis.

If the corresponding bolting device element has a stop surface for limiting a rotary movement of the bolting device element, limiting the rotary movement in the bolting device element mounting may be dispensed with. This can also guarantee a defined, reproducible locking position which the bolting device element can be reached whenever the corresponding bolting device element is not contaminated.

A corresponding element adapted to the pivoting movement of the locking hook can be achieved in that the corresponding bolting device element of the cooking unit door has at least one limiting surface which, when the equipment door is closed, forms a section of a surface area that is axially symmetrically to the rotating axis of the bolting device element. Designs of the invention in which the corresponding bolting device element has the shape of a segment of a circle, in particular the shape of a quadrant, are particularly advantage. A radial limiting surface of the corresponding bolting device element may then be used as a stop surface.

Overloading of the actuator if the bolting device element is blocked can be avoided if the bolting device element is connected by a torsional spring element to the actuator unit.

If, in addition, the torsional spring element is formed by the rod between the actuator unit and the locking hook, costs can be saved and the number of components can be reduced.

If the device comprises at least one sensor element for detecting a position of the bolting device element, the locking action can be safely guaranteed and the risk of burning may be reduced for the operator. Furthermore, contamination of the corresponding bolting device element in the equipment door can be detected by the fact that the bolting device element does not reach a locking position despite the corresponding activity of the actuator unit. If this is the case, a control unit of the cooking unit may block the pyrolysis function to avoid risks and, if necessary, request the operator to clean the corresponding bolting device element.

Incomplete locking can be prevented if, in addition to the sensor element for detecting the position of the bolting device element, the device comprises at least one further sensor element. The further sensor element may, for example, be designed at low cost and robustly as a reed switch.

A universally applicable locking device can be achieved if the bolting device element and the sensor element can be interchanged relative to their position of installation. In particular, a retaining device can be used for such a sensor element for retaining the bolting device element, thereby reducing the design cost. In the case of equipment doors that can be pivoted about a vertical pivoting axis, in particular, the interchangeability of the locking device and the sensor element can be ensured in that the bolting device element is always arranged on a side of the upper or lower edge of the cooking unit door that is advantageous in terms of the lever action.

If the actuator unit is provided for being arranged in a rear half of the cooking device comprising the equipment door, relative to a cooking space opening that can be sealed by the equipment door, the installation space in the front half of the cooking device, which is generally available only to a very limited extent, can be advantageously used for other purposes.

Further advantages are evident from the following description of the figures. The figures show an exemplary embodiment of the invention. The figures, the description and the claims contain numerous combined characteristics which the person skilled in the art will also consider individually and combine to provide further logical combinations.

Figure 2:
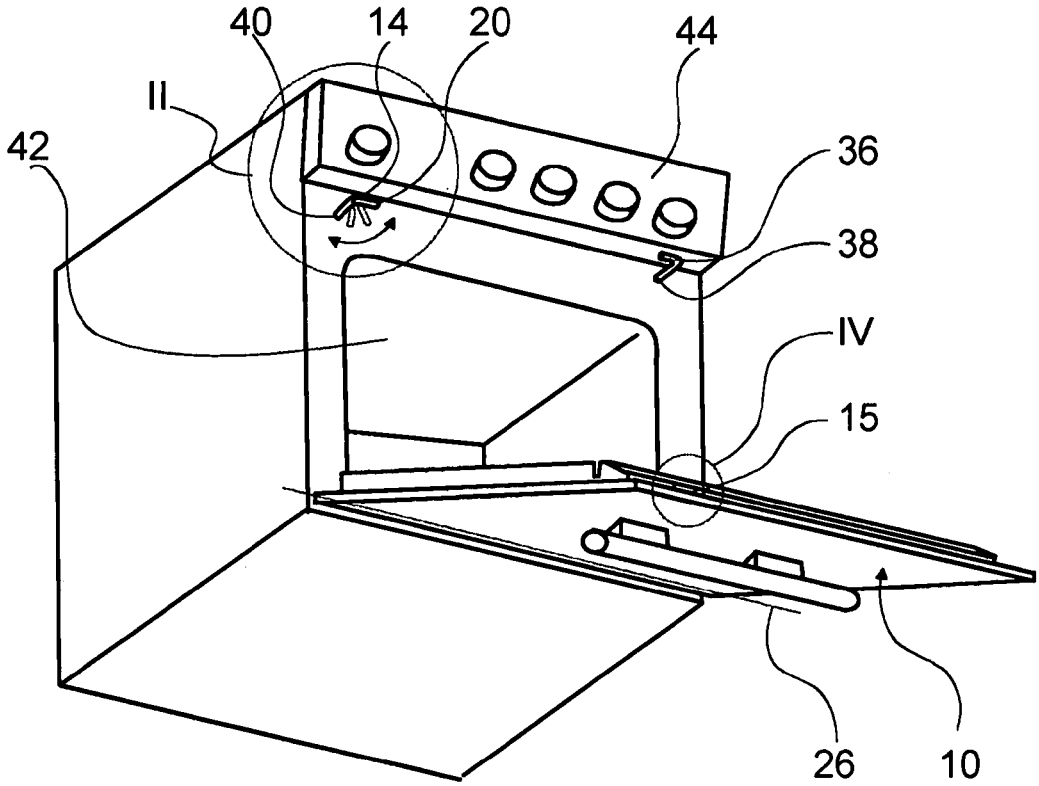
Figure 3:
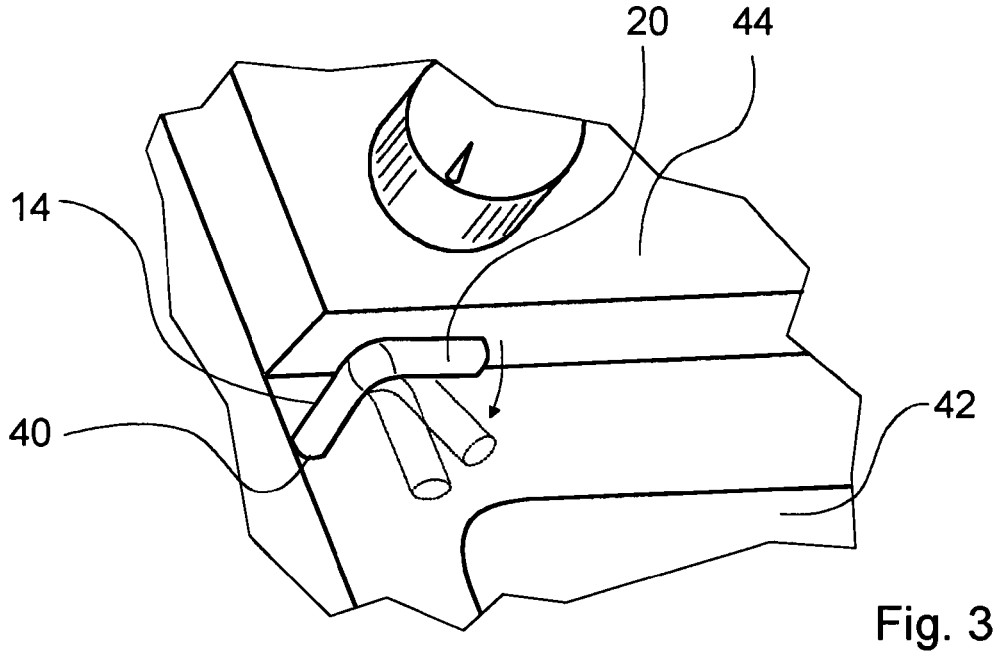
Figure 4:
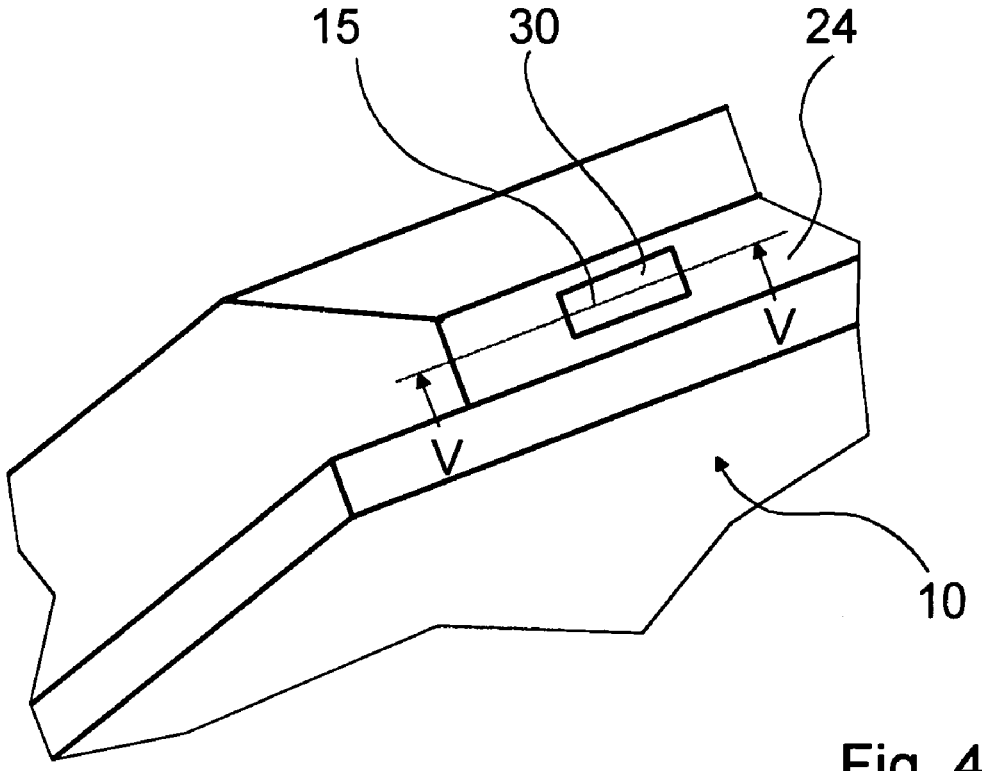
Figure 5:
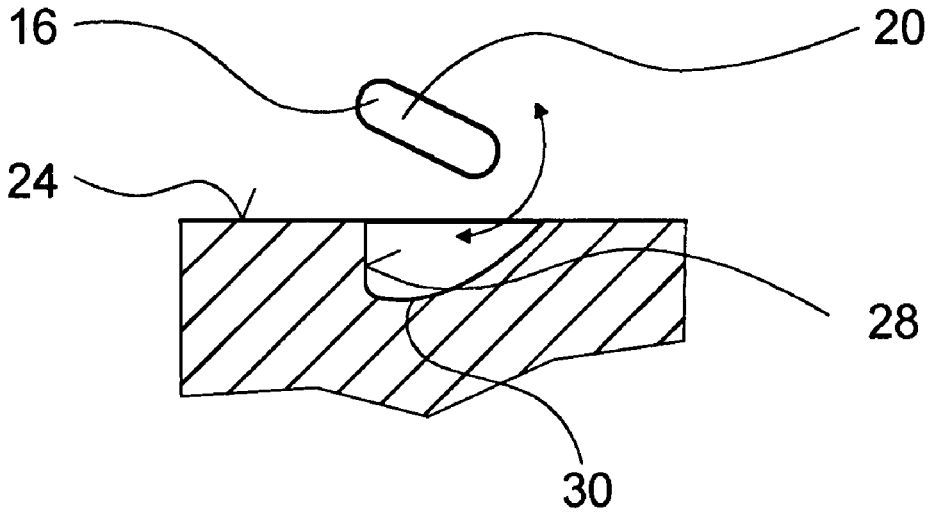

FIG. 1 shows a cooking device with an equipment door, a bolting device element and an actuator in a partial section, FIG. 2 shows the cooking device in FIG. 1, with the equipment door open, in an obliquely downward view, FIG. 3 shows a detailed view of a locking hook of the bolting device element in FIGS. 1 and 2, FIG. 4 shows a detailed view of the equipment door in FIGS. 1 and 2, with a corresponding bolting device element, and FIG. 5 shows a sectional representation of the corresponding bolting device element in FIG. 5.

FIG. 1 shows a cooking device designed as a domestic oven with a pyrolysis function, with an equipment door 10, an actuator unit 12 and with a bolting device element 14 for locking the equipment door 10. Bolting device element 14 serves to lock the equipment door 10, particularly during the performance of the pyrolysis function, actuator unit 12 being provided to bring bolting device element 14 into engagement with a corresponding bolting device element 15 or with a locking shell of equipment door 10 for locking equipment door 10 when equipment door 10 is closed.

Bolting device element 14 is rotatable about a rotating axis 16 by means of actuator unit 12, which axis, when equipment door 10 is closed, runs perpendicularly to a door plane and, when the cooking device is erected, runs horizontally above a cooking space.

Bolting device element 14 comprises a rod 18 and a locking hook 20 running perpendicularly to rotating axis 16. Rod 18 bridges a distance of at least 20 cm between actuator unit 12 and locking hook 20. Locking hook 20 projects at right angles from rod 18. Rod 18 is mounted rotatably and axially fixedly in a guide bearing 22 on a cooking device body of the cooking device. Guide bearing 22 screens all the forces acting in the region of locking hook 20 on bolting device element 14 from actuator unit 12, so that it cannot be damaged, even by pulling on equipment door 10.

Corresponding bolting device element 15 of equipment door 10 is designed as a shell-shaped recess or as a locking shell in a lateral edge surface 24 of equipment door 10, which has the shape of a quadrant in a view perpendicular to equipment door 10 (FIG. 5).

Equipment door 10 is pivotable by means of hinges, not shown explicitly here, about a pivoting axis 26 running along a first, lower edge. Corresponding bolting device element 15 is arranged on an upper lateral edge of equipment door 10 opposing the first edge (FIG. 4).

A radial limiting surface 30 of corresponding bolting device element 15, aligned perpendicularly to pivoting axis 26 of pivoting axis 26 of equipment door 10, forms a stop surface 28 for limiting a rotary movement of bolting device element 14.

A further limiting surface 30 of corresponding bolting device element 15 forms a section of a surface area that is axially symmetrical to rotating axis 16 of bolting device element 14 when equipment door 10 is closed, in particular a section of a cylindrical surface area.

Rod 18, by means of which bolting device element 14 or locking hook 20 is connected to actuator unit 12, forms a torsional spring element 32. If, for example, equipment door 10 is not fully closed, or if corresponding bolting device element 15 of equipment door 10 is contaminated, locking hook 20 cannot reach stop surface 28. Because of the torsion of rod 18 or torsional spring element 32, the loading of actuator unit 12 nevertheless remains within a permissible range and damage to actuator unit 12 by overheating or similar can be avoided.

If bolting device element 14, with the locking hook, rotates beyond the locking position defined by stop surface 28 when the locking is activated, corresponding bolting device element 15 is not present in the locking position because, for example, equipment door 10 is not fully closed.

The cooking device comprises a sensor element 34 for detecting a position of bolting device element 14, by means of which a central control unit is able to detect whether bolting device element 14 is in the locking position. The latter is a necessary condition for locking equipment door 10.

Moreover, the cooking unit has a further sensor element 36, designed as a reed switch, for detecting a position of equipment door 10. This also enables the control unit to detect an adequate condition for locking equipment door 10. Only when bolting device element 14 is in the locking position and equipment door 10 is fully closed, a safe positive connection exists and equipment door 10 can no longer be opened. The control unit does not initiate a pyrolysis process until all the conditions are met.

Bolting device element 14 and further sensor element 36, for detecting a position of equipment door 10, extend through similar types of recesses 38, 40 in a front plate of a muffle 42 of the cooking device. Both units are therefore interchangeable in terms of their installation position.

Actuator unit 12 itself is arranged above muffle 42 in a rear half of the cooking unit relative to a cooking space opening that can be sealed from equipment door 10. The installation space in the front half of the cooking device therefore remains free for other modules which can be operated directly by means of an operating diaphragm 44 of the cooking device and should therefore be arranged in the immediate vicinity of the latter to form a compact module.

REFERENCE NUMBERS

10 Cooking devise door
12 Actuator unit
14 Bolting device element
15 Bolting device element
16 Rotating axis
18 Rod
20 Locking hook

22 Guide bearing
24 Edge surface
26 Pivoting axis
28 Stop surface
30 Limiting surface
32 Torsional spring element
34 Sensor element
36 Sensor element
38 Recess
40 Recess
42 Muffle
44 Operating diaphragm

The invention claimed is:

1. A device with an equipment door, an actuator unit and a bolting device element for locking the equipment door for performing a pyrolysis function, the actuator unit bringing the bolting device element into engagement with a corresponding element of the equipment door for locking the equipment door when the equipment door is closed, wherein the bolting device element is rotatable about a rotating axis running substantially perpendicularly to a door plane of the equipment door when the equipment door is closed, wherein the actuator unit is arranged in a rear half of a cooking device comprising the equipment door relative to a cooking space opening that can be sealed using the equipment door.

2. The device according to claim 1, wherein the bolting device element has a locking hook running at least essentially perpendicularly to the rotating axis.

3. The device according to claim 2, wherein the bolting device element comprises a rod which bridges a distance between the actuator unit and the locking hook.

4. The device according to claim 3, wherein the rod is mounted rotatably and axially fixedly in a guide bearing on an equipment body.

5. The device according to claim 3, wherein the distance is at least 20 cm.

6. The device according to claim 1, wherein the corresponding receiver element of the equipment door is formed as a recess in a lateral edge surface of the equipment door.

7. The device according to claim 1, wherein the equipment door is pivotable about a pivoting axis running along a first edge, and the corresponding receiver element is arranged on a lateral edge of the equipment door opposing the first edge.

8. The device according to claim 1, wherein the corresponding receiver element has a stop surface for limiting a rotary movement of the bolting device element.

9. The device according to claim 1, wherein the corresponding receiver element of the equipment door has at least one limiting surface which, when the equipment door is closed, forms a section of a surface area that is axially symmetrical to the rotating axis of the bolting device element.

10. A device with an equipment door, an actuator unit and a bolting device element for locking the equipment door for performing a pyrolysis function, the actuator unit bringing the bolting device element into engagement with a corresponding element of the equipment door for locking the equipment door when the equipment door is closed, wherein the bolting device element is rotatable about a rotating axis running substantially perpendicularly to a door plane of the equipment door when the equipment door is closed and wherein the bolting device element is connected by a torsional spring element to the actuator unit.

11. The device according to claim 10, wherein the bolting device element has a locking hook running at least essentially perpendicularly to the rotating axis and comprises a rod which bridges a distance between the actuator unit and the locking hook, wherein the torsional spring element is formed by the rod between the actuator unit and the locking hook.

12. A device with an equipment door, an actuator unit and a bolting device element for locking the equipment door for performing a pyrolysis function, the actuator unit bringing the bolting device element into engagement with a corresponding element of the equipment door for locking the equipment door when the equipment door is closed, wherein the bolting device element is rotatable about a rotating axis running substantially perpendicularly to a door plane of the equipment door when the equipment door is closed and further comprising a sensor element for detecting a position of the bolting device element.

13. The device according to claim 12, further comprising at least one additional sensor element for detecting a position of the equipment door.

14. The device according to claim 13, wherein the bolting device element and the further sensor element are interchangeable in terms of their installation position.

* * * * *